US006401824B1

(12) United States Patent
Musselwhite et al.

(10) Patent No.: US 6,401,824 B1
(45) Date of Patent: Jun. 11, 2002

(54) WELL COMPLETION CONVERTIBLE FLOAT SHOE/COLLAR

(75) Inventors: Jeffrey D. Musselwhite; Jeffry C. Ehlinger, both of Houston; Jerry P. Allamon, Montgomery; Jack E. Miller, Houston, all of TX (US)

(73) Assignee: Davis-Lynch, Inc., Pearland, TX (US)

( * ) Notice: Subject to any disclaimer, the term of this patent is extended or adjusted under 35 U.S.C. 154(b) by 0 days.

(21) Appl. No.: 09/524,117

(22) Filed: Mar. 13, 2000

(51) Int. Cl.[7] ..... E21B 17/14

(52) U.S. Cl. ..... 166/327; 166/242.8; 166/332.8; 166/334.4

(58) Field of Search ..... 166/242.8, 156, 166/154, 194, 222, 327, 328, 334.4, 332.8, 386

(56) References Cited

U.S. PATENT DOCUMENTS

| | | | | |
|---|---|---|---|---|
| 2,735,498 A | | 2/1956 | Muse | |
| 2,751,021 A | | 6/1956 | Muse | |
| 3,032,050 A | | 5/1962 | Clark, Jr. | |
| 3,148,731 A | | 9/1964 | Holden | |
| 3,995,692 A | | 12/1976 | Seitz | |
| 4,469,174 A | * | 9/1984 | Freeman | 166/285 |
| 4,474,241 A | | 10/1984 | Freeman | |
| 4,664,192 A | | 5/1987 | Hogarth | |
| 4,688,593 A | | 8/1987 | Pringle et al. | |
| 4,729,432 A | | 3/1988 | Helms | |
| 4,846,281 A | | 7/1989 | Clary et al. | |
| 5,337,819 A | * | 8/1994 | Tailby | 166/222 |
| 5,474,130 A | * | 12/1995 | Davis | 166/312 |
| 6,244,342 B1 | | 6/2001 | Sullaway et al. | |

* cited by examiner

*Primary Examiner*—David Bagnell
*Assistant Examiner*—Zakiya Walker
(74) *Attorney, Agent, or Firm*—The Matthews Firm

(57) ABSTRACT

An improved float shoe/collar apparatus is provided for use during casing run in or floated in. The apparatus has an inner tubular member and outer tubular member, movable upon release of shear pins to cause longitudinal movement relative to each other. The movement of the inner tubular member closes a plurality of downward jets and opens a plurality of upward jets. The apparatus also is equipped with a set of check valves, held open on run in, and activated to close upon cementing to prevent "u-tubing" of fluid back into the casing.

18 Claims, 2 Drawing Sheets

WELL COMPLETION CONVERTIBLE FLOAT SHOE/COLLAR

FIELD OF INVENTION

This invention relates generally to apparatus for use in well completions in wells where it is undesirable to put excess pressure on the well bore caused by lowering the casing into the well bore.

BRIEF DESCRIPTION OF THE PRIOR ART

In the process of drilling a well it becomes necessary to stabilize the borehole from collapse of its walls, to set well casing in the well bore and to fix it in place by cementing it in place. The well may then be drilled further, or the completion process to begin hydrocarbon production may be carried out.

In vertical or horizontal boreholes, or sections of a well having vertical and horizontal boreholes, one or more casing strings are lowered into the hole and are anchored therein by a column of cement placed in the annulus between the casing string and the wall of the borehole. It has become conventional practice to fill the casing string with heavy drilling fluid or mud which prevents the increasing subterranean pressure from crushing inwardly, or collapsing, the casing string as it is lowered, or floated, into the well bore. When the string has been placed at the desired depth, being held at the surface or placed on a hanger from a previously set casing string of larger diameter, a wiper plug is launched into the casing string and oil well cement is added to the string above the wiper plug. Pressure pumping apparatus at the surface is used to pump the mud, and then the cement out of the lower end of the string and past a float shoe, or well tool having a back pressure valve, at its lower end and into the casing/well bore annulus. It should be mentioned that if the back pressure valve or float shoe is located at the bottom end of the casing string it is referred to as a float shoe. If this device is used interiorly to the length of a full casing string, it is referred to as a float collar. The difference in the use of this type of device as a shoe or a collar is merely whether it is threaded to the casing on one end (shoe), or on both ends (collar).

When the wiper plug lands on the float shoe, increased pumping pressure is used to burst or rupture a frangible diaphragm across the interior of the wiper plug and to permit the cement to go into the annulus, which was above the wiper plug. The back pressure valve in the float shoe prevents the cement placed in the annulus from simply re-entering the casing into any cement ports above the valve. In any case, when the desired amount of cement has been pumped into the annulus and has set, a drilling tool is lowered into the casing string and used to drill out the plug (or plugs) and the float shoe containing the back pressure valve. This opens the lower end of the casing string for further completion operations or drilling.

Some float shoes having mud jets, or directed openings, facing downwardly have been used for assisting lowering of casing into place by providing downwardly directed mud jets during the casing run in to assist circulating out any rock "cuttings" present in the uncased section of borehole.

The downwardly facing jets assist in moving any remaining rock "cuttings" in the well bore to be circulated out of the well via the annulus between the casing and borehole wall during the run in operation. Some such tools used as float shoes have had upwardly facing fluid ports or jets to assist in the distribution of cement into the borehole/casing annulus once the tool is in place. No known float shoes having both types of fluid ports or jets have been used.

In the use of this type of float shoe, one or more back pressure valves (or one way valves) are positioned by cementing them into a short piece of pipe threaded to the end (when used as a shoe) or to a section between casing lengths (when used as a collar) of the casing string. These check valves prevent the re-entry of cement or mud interiorly to the casing during the run in and cementing operation. A float shoe or collar of this type can have other possible valve configurations. Such valves can be configured to only act as check valves when "activated" such as by running in an activation tool or pumping an activation tool or an obscuration ball down the casing string from the surface.

Downwardly facing ports or jets are useful during casing run in. Upwardly facing jets promote the equal circumferential distribution of cement when cementing takes place. The upwardly facing jets create turbulence in the casing/borehole annulus and this tends to promote desired circumferential distribution of cement about the annulus.

It is apparent from the foregoing that it would be highly desirable in optimizing the run in and cementing operation that a float shoe or float collar having jets directed in a downward direction during the run in, and then having jets directed only in an upward direction during the cementing operation, would make such an operation much safer, more economical, and more efficient. The float shoe/collar apparatus of the present invention provides just such a reliable, safe and economical system.

BRIEF DESCRIPTION OF THE INVENTION

The apparatus of the present invention comprises a float shoe (or which could be used as a collar) that incorporates a check valve, or a plurality of such valves, which can allow the casing to fill up from the bottom with well fluid (auto fill) during run in. Below the valve, or valves, is a center outlet hole as well as both upwardly and downwardly facing jets. A tube inside the float shoe holds the flapper (or check) valve(s) mechanism open to allow fluid into the casing. This same tube also covers and closes a set of upwardly facing jets during run in. The downwardly facing jets are open to aid in washing the borehole wall during the casing run in or float in. Once the casing string has reached the desired depth, an obscuration ball or a tool is pumped down the casing. The ball seats in the float shoe tube. With an increase in pumping pressure from the surface, the seated ball then causes the float shoe tube to move downwardly inside the tool. The downward movement allows the check valve(s) (or flappers) to swing closed, thus activating the check valve(s). When the tube shifts downwardly it closes and shuts off the downwardly facing jets and exposes, or opens, the upwardly facing jets to assist in cement distribution, during the cementing operation, to all sides of the casing.

The invention may be best understood by reference to the detailed description thereof which follows and by reference to the appended drawings. The drawings are intended to be illustrative of the preferred embodiment of the invention but are not intended to be limitative of the invention as it may admit to more than one embodiment. It is to be understood that the valves in the float shoe and valves in the float collar may be the same.

DETAILED DESCRIPTION OF A PREFERRED EMBODIMENT

Figure 1:
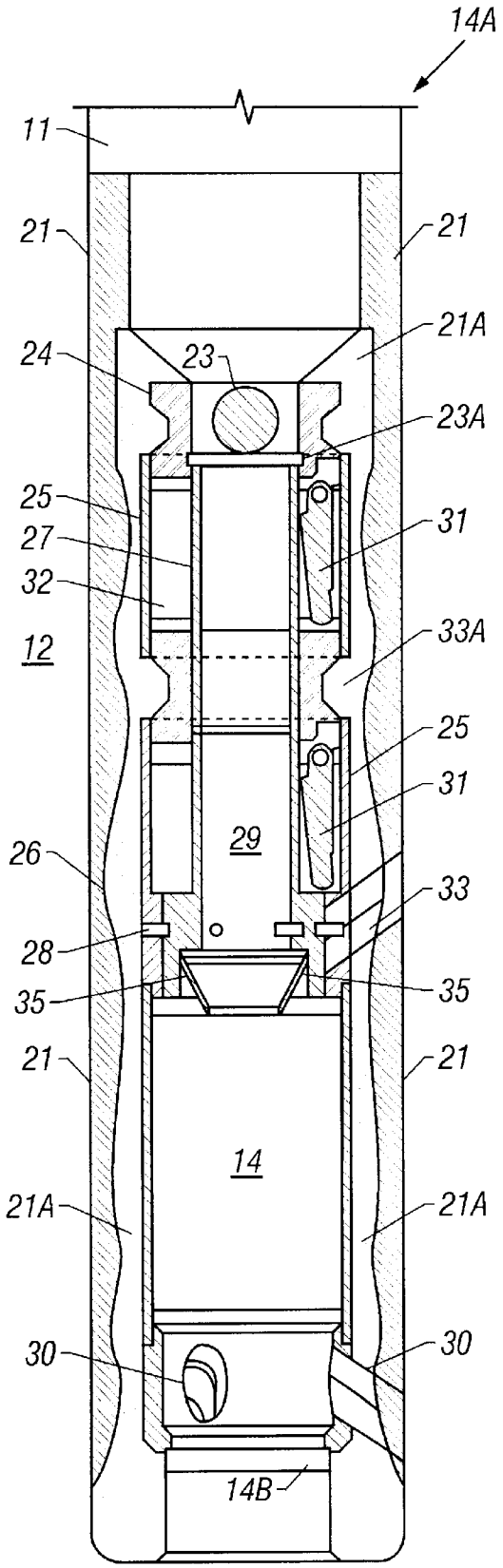
FIG. 1 is a schematic side view in section of the apparatus of one embodiment of the invention (shoe form) in place in a short section of pipe threaded on its upper end to fit the casing string.

Referring initially to FIG. 1, a well tool according to the invention is shown in a side view in section. The tool 14 is included and cemented n a short piece of pipe 21 threaded to fit the casing 11 sections on the casing lower end. FIG. 1 detail of the installation of the tool 14 is shown in the short pipe section 21 which is threaded to fit onto a well casing on the tools' upper end 14A. Short pipe section 21 is provided with interior teeth or threads 26 and outer cylindrical body member 25 is held in place by cured cement or other attachment means 21A prior to its attachment to the casing string being run in and cemented in place. A movable inner tubular member 27 is held in place with respect to outer member 25 by one or more shear pins 28. The shear pins 28 are designed to shear when a desired lateral force is applied to them (as will be described) and to then permit downward it longitudinal movement of inner member 27 with respect to outer member 25. When the cementing operation is complete, the entire float shoe assembly 14 is constructed of such readily frangible material as to make it readily drillable by a tool lowered through the set casing.

In FIG. 1 an activation ball 23 is shown seated on a catcher/seat 23A. In the run in operation, of course, ball 23 could be kept on the surface until it is desired to activate the apparatus of FIG. 1. The bore 29 of inner member 27 may be fully open during the run in for auto fill. The outer member 25 is provided at its lower end with a plurality of downwardly facing jet openings 30 which are open in the position shown during the run in operation. The bottom opening 14B of tool 14 may also be open during run in to allow fluid entry/exit through it and jets 30 into the borehole. Fluid pumped under pressure from the surface exits all the openings and, if desired, circulation may be maintained to "wash" rock cuttings left in the hole upwardly in the annulus 12 during this operation, assisted by the operation of downwardly facing fluid jets 30.

The outer member 25 is provided with a plurality of check valves 31, shown as flapper valves 31, which are held in their open or unactivated position in the interior annulus 32 between inner member 27 and the outer member 25 in the run position. The outer member 25 and the pipe section 21 are also provided with upwardly facing j et openings 33 and 33A which are initially blocked in the run in position as shown in FIG. 1.

Figure 2:
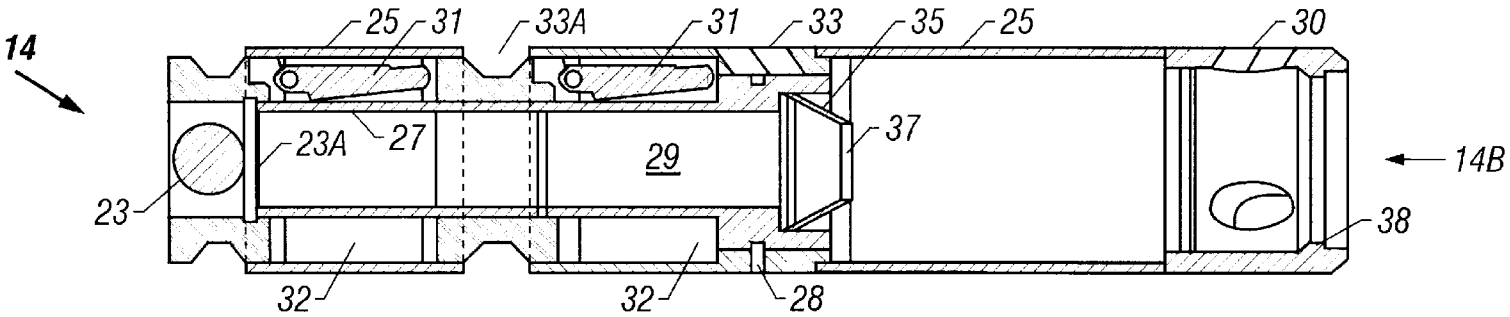
FIG. 2 is a schematic side view in sections of a portion of the apparatus of FIG. 1 with the internal tube in its upward position.
Figure 3:
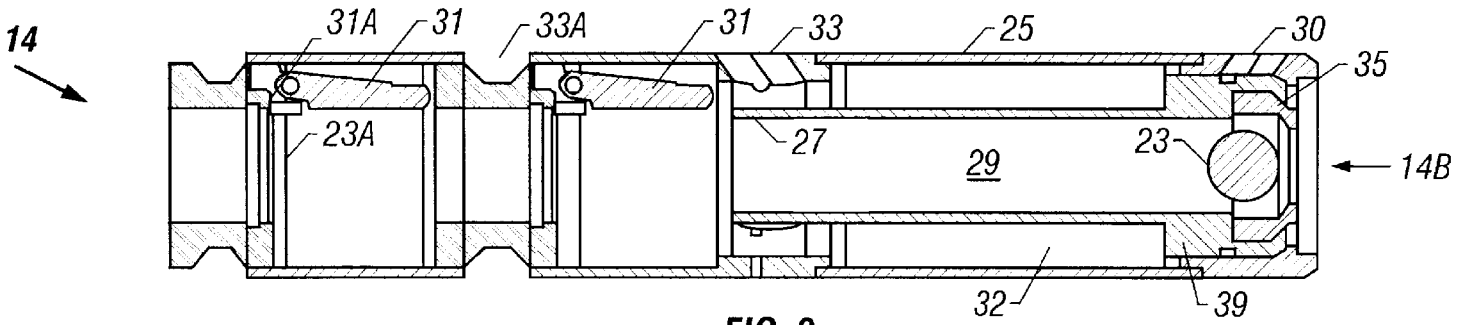
FIG. 3 is a schematic side view in section of the apparatus of FIG. 1 and 2 with the internal tube in its downward position and with the check valves closed or activated.
Figure 4:
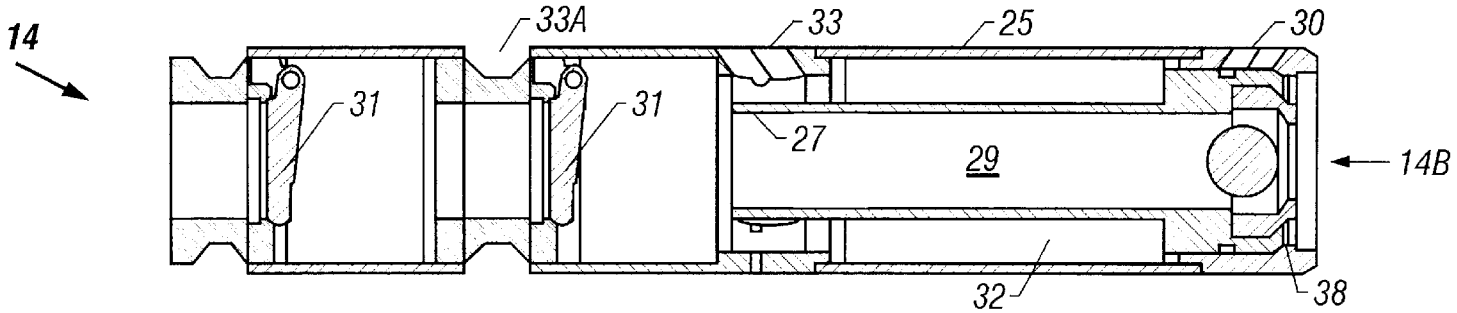
FIG. 4 is a schematic side view in section of the apparatus of FIGS. 1, 2 and 3 with the check valves.

Referring now to FIGS. 2, 3 and 4, the portion of the float shoe of FIG. 1 held in the cement sheath 21A is shown in three different positions. FIG. 2 shows the apparatus in the auto fill up mode (or run in mode) with bore 29 fully open to fluid flow and fluid jets 30 and bottom opening 14B also fully open. FIG. 4 shows activation ball 23 caught on a catcher portion 35 of inner member 27 at its lower end and with the member 27 released to move, having sheared off the shear pins 28 of FIG. 1 forming a movable integral piston which has moved downwardly until caught on a shoulder 38 of outer member 25 at its lower end. The piston formed by movable inner member 27 has blocked off downwardly facing jets 30 and also the lower opening 14B of the shoe 14. In FIG. 3 the valves 31 are still open, being held there after passage of piston assembly member 27 by fluid pressure from above. This motion of member 27 has also uncovered the upwardly facing jets 33A of member 25 allowing cement to be exited and distributed to the annulus between the casing and borehole wall, equally about all exterior sides of casing string 11.

A brief release of the pumping pressure from the surface allows valves 31 to close and seat, thus preventing the cement from "u tubing" or "flowing" back into the casing between pump strokes. Valves 31, when activated, thus act as check valves for this purpose. This arrangement of the apparatus of the invention provides an optimal jetting action during run in, which is switched over or converted into an optimal jetting action for cement distribution, automatically upon activation of the downhole check valves. The system is safe and economical and very reliable.

The invention may admit to other embodiments than that shown when disclosed to those skilled in the art. It is the aim of the appended claims to cover all such modifications and variations that fall within the true spirit and scope of the invention.

What is claimed is:

1. A well completion float shoe/collar tool comprising:

an outer tubular member and an inner tubular member, said outer tubular member having both upwardly facing and downwardly facing fluid jet openings and having an open lower end, said upwardly facing fluid jet openings being initially closed by said inner tubular member during casing string run in;

one or more flapper valves mounted between said inner tubular member and said outer tubular member;

said inner tubular member having a bore there through initially open to fluid flow and permitting fluid flow to said downwardly facing fluid jet openings and permitting fluid flow upwardly from said open end of said outer tubular trough said inner tubular; and means for causing longitudinal movement of said inner member with respect to said outer member, said movement causing said downwardly acing jets to close and said upwardly facing jets to open.

2. The tool of claim 1 further comprising an outermost tubular mounted outside said outer tubular member and said inner tubular member.

3. A well completion float shoe/collar tool for use in a wellbore comprising:

an inner tubular member and an outer tubular member, said outer tubular member having a tubular axis, said outer tubular member having both upwardly angled and downwardly angled fluid jet openings therein, said upwardly angled and said downwardly angled fluid jet openings each having a respective bore axis, each said respective bore axis being non-parallel with respect to said tubular axis;

a plurality of flapper valves positioned between said inner tubular member and said outer tubular member, said plurality of flapper valves having a plurality of closure elements and a plurality of valve seats, said inner tubular member being initially positioned such that said inner tubular member extends through said plurality of flapper valves and covers said plurality of flapper valve seats and maintains said plurality of closure elements in an open position such that fluid may flow trough said plurality of flapper valves in two directions; and means for selectively closing one or the other of said fluid jet openings in said outer tubular.

4. The tool of claim 3 wherein said means for selectively closing comprises means for causing relative motion of said inner tubular member with respect to said outer tubular member.

5. The tool of claim 4 wherein said relative motion comprises longitudinal relative motion of said inner tubular member moving with respect to said outer tubular member.

6. The tool of claim 5 wherein said longitudinal relative motion is caused by means of obturating an internal passage of said inner tubular member.

7. The tool of claim 6 wherein said obturating means includes a ball pumped down under fluid pressure from the surface of the earth to said tool.

8. The tool of claim 3 wherein said outer tubular member is an outermost tubular for said well completion float shoe collar tool such that no other tubular is mounted outside of said outer tubular member.

9. The tool of claim 8 further comprising a lowermost end of well completion float shoe/collar tool, said outer tubular being substantially rigid so as to remain in a fixed position with respect to said lowermost end while said inner tubular member is relatively movable with respect to said lowermost end.

10. The tool of claim 3 wherein said plurality of flapper valves are held in their open position as said well completion float shoe/collar tool is lowered into said wellbore.

11. A float equipment assembly for lowering a tubular string from a surface position into a wellbore and for cementing said tubular string in position, said assembly comprising:

an outer tubular affixed to said tubular sting, said outer tubular having an open lower end which opens into said wellbore to permit fluid flow into or out of said open lower end during a two-way flow mode of operation of said float equipment;

a first flapper valve body mounted within said outer tubular, said first flapper valve body defining a first bore therethrough;

a first flapper closure element pivotally mounted to said first flapper valve body for pivotal movement between an open position and a closed position, said first flapper closure element being selectively operable between said two-way flow mode and a one-way flow mode, in said two-way flow mode said first flapper closure element being secured in said open position to permit fluid flow trough said first bore in a direction toward said surface position aid also to permit fluid flow in a direction away from said surface position, in said one-way flow mode said first flapper closure element being pivotally movable between said open position and said closed position responsively to fluid flow direction and being mounted to thereby prevent fluid flow through said first bore in said direction toward said surface position and to permit fluid flow in said direction away from said surface position;

a second flapper valve body mounted within said outer tubular, said second flapper valve body defining a second bore therethrough;

a second flapper closure element pivotally mounted to said second flapper valve body for pivotal movement between an open position and a closed position, said second flapper closure element being selectively operable between said two-way flow mode and said one-way flow mode, in said two-way flow mode said second flapper closure element being secured in said open position to permit fluid flow through said second bore in said direction toward said surface position and also to permit fluid flow in said direction away from said surface position, in said one-way flow mode said second flapper closure element being pivotally movable between said open position and said closed position responsively to fluid flow direction and being mounted to thereby prevent fluid flow through said second bore in said direction toward said surface position and to permit fluid flow in said direction away from said surface position; and an inner tubular having an inner tubular flow path therethrough for receiving fluid flow from said wellbore in said two-way flow mode when lowering said tubular string into said wellbore, said inner tubular being initially securable at a first axial position with respect to said outer tubular, in said first axial position said inner tubular being mounted to extend simultaneously through both said first bore and said second bore to thereby secure said first flapper closure element in said open position for operation in said two-way flow mode and to secure said second flapper closure element in said open position for operation in said two-way flow mode, said inner tubular being axially movable from said first axial position away from said first flapper valve body and said second flapper valve body to thereby release said first flapper closure element for operation in said one-way flow mode and also to release said second flapper element for operation in said one-way flow mode.

12. The apparatus of claim 11 further comprising said outer tubular being rigidly secured with respect to said tubular string so as to remain in a fixed position with respect to said tubular string during both said one-way flow mode aid said two-way flow mode, said outer tubular being an outermost tubular along an axial length between said open lower end and said second flapper valve body.

13. The apparatus of claim 11, further comprising a shear element for securing said inner tubular in said first axial position, said inner tubular being mounted for unrestricted movement away from said first flapper valve body and said second flapper valve body to release said first flapper closure element for operation in said one-way flow mode and also to release said second flapper element for operation in said one-way flow mode after shearing of said shear element.

14. Float equipment assembly for lowering a tubular string from a surface position into a wellbore and for cementing said tubular string in position, said assembly comprising:

an outer tubular member forming a lowermost position of said tubular string, said outer tubular member having a lower end with one or more openings to provide fluid communication with said wellbore;

an inner tubular member moveable between a first position and a second position with respect to said outer tubular member, said lower end of said outer tubular member permitting fluid flow to said inner tubular member during said lowering of said tubular string into said wellbore while said inner tubular member is in said first position, said inner tubular member defining a seat, said inner tubular member being moveable between said first position and said second position in response to receipt of a drop member into said seat; and a plurality of flapper valves mounted between said inner tubular member and said outer tubular member, said plurality of flapper valves being affixed in an open position when lowing said tabular string into said wellbore, said plurality of flapper valves being operable for movement between an open position and a closed position after movement of said inner tubular member from said first position to said second position such that said plurality of flapper valves permit fluid flow in one direction after movement of said inner tubular member from said first position to said second position and block fluid flow in an opposite direction; and a shear member that shears in response to said receipt of said drop member into said seat, said inner tubular member being mounted for unrestricted movement between said first position and said second position after said shear member is sheared.

15. The assembly of claim 14, said outer tubular member being an outermost tubular along an axial length between said lower end and said plurality of flapper valves, said outer tubular member being rigidly affixed to said tubular string during movement of said inner tubular member with respect to said outer tubular member.

16. Float collar/shoe equipment for use in lowering a tubular string into a wellbore and for cementing the tubular string in position, comprising:

an outer tubular member affixed to said tubular string;

an inner tubular member moveable between a first position and a second position with respect to said outer tubular member, said outer tubular member having initially a substantially unrestricted lower open end leading to said well bore to permit substantially unrestricted fluid flow from said lower open end through said inner tubular member during said lowering of said tubular string into said wellbore while said inner tubular member is in said first position; and a plurality of one-way valves positioned between said inner tubular member and said outer tubular member, said plurality of one-way valves having a plurality of closure elements and a plurality of valve seats, said inner tubular member being positioned in said first position such that said inner tubular member simultaneously extends through said plurality of one-way valves and maintains said plurality of closure elements in an open position such that fluid may flow through said plurality of one-way valves in two directions, said inner tubular member being moveable to said second position to thereby permit said closure elements to close such that said plurality of one-way valves then permit fluid flow in only one direction and block fluid flow in an opposite direction.

17. The apparatus of claim 16 further comprising said outer tubular member being rigidly secured to said tubular string so as to remain remain in a fixed position with respect to said tubular string, said outer tubular member being an outermost tubular along an axial length between said lower open end and said plurality of one-way valves.

18. The apparatus of claim 16 further comprising a shear element for securing said inner tubular member in said first position, said inner tubular member being mounted for unrestricted movement after shearing of said shear element to said second position to thereby permit said closure elements of said plurality of one-way valves to close such that said plurality of one-way valves then permit fluid flow in only one direction and block fluid flow in an opposite direction.

* * * * *

UNITED STATES PATENT AND TRADEMARK OFFICE

CERTIFICATE OF CORRECTION

PATENT NO. : 6,401,824 B1 
DATED : June 11, 2002
INVENTOR(S) : Jeffrey D. Musselwhite et al.

It is certified that error appears in the above-identified patent and that said Letters Patent is hereby corrected as shown below:

Column 3,
Line 3, after "check valves", change "closed or activated" to -- open or deactivated --.
Line 5, after "check valves", add -- closed or activated. --.
Line 12, after "cemented" change "n" to -- in --.
Line 29, after "shown" delete "seated on a catcher/seat 23A" and substitute the following -- in its dropped status on the way to being seated on the catcher portion 35. --.
Lines 50 and 51, after "jet openings 33" delete "and 33A".

Column 4,
Line 2, after "jets" change "33A" to -- 33 --.
Line 34, change "trough" to -- through --.
Line 37, change "acing" to -- facing --.
Line 60, change "trough" to -- through --.

Column 5,
Line 27, change "sting" to -- string, --.
Line 43, change "trough" to -- through --.
Line 44, change "aid" to -- and --.

Column 6,
Line 30, change "aid" to -- and --.
Line 62, change "lowing said tabular" to -- lowering said tubular --.

Column 8,
Line 16, change "remain remain" to -- remain --.

UNITED STATES PATENT AND TRADEMARK OFFICE

CERTIFICATE OF CORRECTION

PATENT NO. : 6,401,824 B1 
DATED : June 11, 2002
INVENTOR(S) : Jeffrey D. Musselwhite et al.

It is certified that error appears in the above-identified patent and that said Letters Patent is hereby corrected as shown below:

Drawings,

Figs. 2, 3 and 4, the drawings are rotated showing the correct placement of the top end 14 of each of the figures.

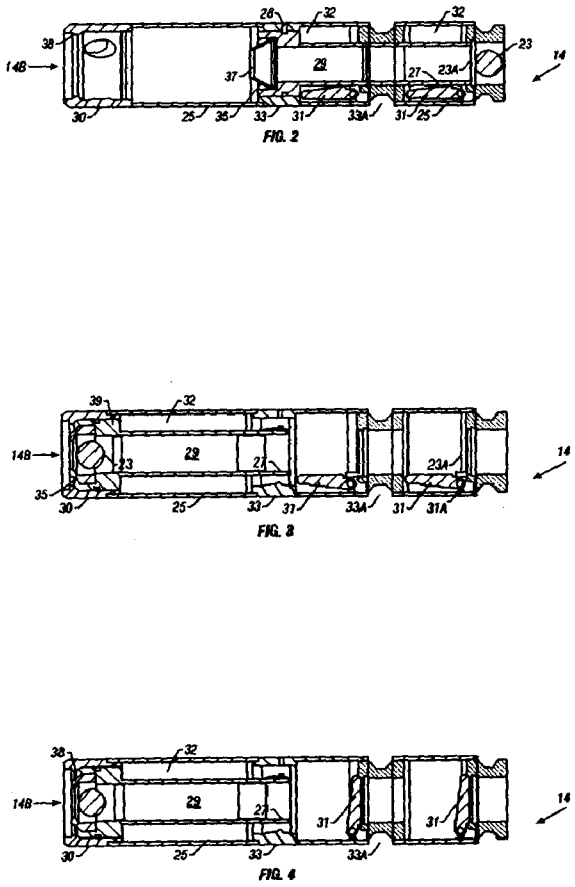

Signed and Sealed this

Thirty-first Day of December, 2002

JAMES E. ROGAN
*Director of the United States Patent and Trademark Office*

US006401824C1

(12) EX PARTE REEXAMINATION CERTIFICATE (5913th)

United States Patent

Musselwhite et al.

(10) Number: US 6,401,824 C1

(45) Certificate Issued: Oct. 2, 2007

(54) WELL COMPLETION CONVERTIBLE FLOAT SHOE/COLLAR

(75) Inventors: Jeffrey D. Musselwhite, Houston, TX (US); Jeffry C. Ehlinger, Houston, TX (US); Jerry P. Allamon, Montgomery, TX (US); Jack E. Miller, Houston, TX (US)

(73) Assignee: Davis Lynch, Inc., Pearland, TX (US)

Reexamination Request:
No. 90/007,349, Dec. 21, 2004
No. 90/007,585, Jun. 13, 2005

Reexamination Certificate for:

| | |
|---|---|
| Patent No.: | **6,401,824** |
| Issued: | **Jun. 11, 2002** |
| Appl. No.: | **09/524,117** |
| Filed: | **Mar. 13, 2000** |

Certificate of Correction issued Dec. 31, 2002.

(51) Int. Cl.
*E21B 17/14* (2006.01)

(52) U.S. Cl. ..... 166/327; 166/242.8; 166/332.8; 166/334.4

(58) Field of Classification Search ..... 166/327, 166/242.8, 332.8, 334.4
See application file for complete search history.

(56) References Cited

U.S. PATENT DOCUMENTS

| | | | |
|---|---|---|---|
| 2,295,822 | A | 9/1942 | Armentrout |
| 2,735,498 | A | 2/1956 | Muse |
| 3,148,731 | A | 9/1964 | Holden |
| 3,799,204 | A | 3/1974 | Watkins |
| 4,709,760 | A | 12/1987 | Crist |
| 4,825,944 | A | 5/1989 | Mays |
| 4,967,841 | A | 11/1990 | Murray |
| 5,024,273 | A | 6/1991 | Coone |
| 5,411,095 | A | 5/1995 | Ehlinger |
| 5,533,571 | A | 7/1996 | Surjaatmadja |
| 5,819,853 | A | 10/1998 | Patel |
| 6,125,930 | A | 10/2000 | Moyes |
| 6,296,059 | B1 | 10/2001 | Leeb et al. |
| 6,390,200 | B1 | 5/2002 | Allamon et al. |
| 6,467,546 | B2 | 10/2002 | Allamon et al. |
| 6,484,804 | B2 | 11/2002 | Allamon et al. |
| 6,491,103 | B2 | 12/2002 | Allamon et al. |
| 6,513,590 | B2 | 2/2003 | Allamon et al. |

OTHER PUBLICATIONS

"Assembly for Flapper Valve Insert for Sub–Sea Re–entry Cement Float Shoe with TV Camera for XO–07238," Baker Commodity No. 02–35733–00 (dated Jan. 23, 1976.).
"Pumpout Sleeve F/Flapper Valve Insert Assy. #233–733" Baker Commodity No. 02–33686–00 (dated Jan. 15, 1976.).
"Proposed 24¼ O.D. Stab–In Circulating Flexifill with Double Flapper Valve & Captive Ball (F/BP)" Unknown Baker Commodity Number (dated Jun. 25, 1984.).
"Top Sub," Taylor Made Oil Tools, Inc. Part No. FV–3–500–13 (Jul. 7, 1997.).
"Upper Flapper Body," Taylor Made Oil Tools, Inc. Part No. FV–3–500–2 (Jul. 7, 1997.).
"Lower Flapper Body," Taylor Made Oil Tools, Inc. Part No. FV–3–500–3 (Jul. 7, 1997.).
"Flapper Assembly," Taylor Made Oil Tools, Inc. Part No. FV–3–500–4 (Jul. 7, 1997.).
"Bottom Sub," Taylor Made Oil Tools, Inc. (Jul. 7, 1997.).
"Pin," Taylor Made Oil Tools, Inc. (Jul. 7, 1997.).
"Flapper Pin Housing," Taylor Made Oil Tools, Inc. (Jul. 7, 1997.).
"Shear Body," Taylor Made Oil Tools, Inc. Part No. FV–3–500–8 (Jul. 7, 1997.).

(Continued)

*Primary Examiner*—Matthew C. Graham

(57) ABSTRACT

An improved float shoe/collar apparatus is provided for use during casing run in or floated in. The apparatus has an inner tubular member and outer tubular member, movable upon release of shear pins to cause longitudinal movement relative to each other. The movement of the inner tubular member closes a plurality of downward jets and opens a plurality of upward jets. The apparatus also is equipped with a set of check valves, held open on run in, and activated to close upon cementing to prevent "u-tubing" of fluid back into the casing.

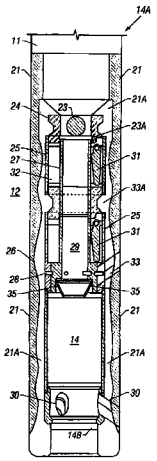

OTHER PUBLICATIONS

"Trap Body," Taylor Made Oil Tools, Inc. Part No. FV–3–500–9 (Jul. 7, 1997.).
"Sleeve," Taylor Made Oil Tools, Inc. Part No. FV–3–500–10 (Jul. 7, 1997.).
"Shear Ring," Taylor Made Oil Tools, Inc. Part No. FV–3–500–11 (Jul. 7, 1997.).
"Lock Ring," Taylor Made Oil Tools, Inc. (Jul. 7, 1997.).
"Flapper Valve," Taylor Made Oil Tools, Inc. (Jul. 7, 1997.).
"Dual Flapper Valve," Taylor Made Oil Tools, Inc., http://www.taylormadeoiltools.com/dflapval.htm.
"Hyflow Float Shoe, Product No. FB01, Hyflow Float Collar, Product No. FP01, Orifice Shoe, Product No. FZ25, Orifice Collar, Product No. FZ55, Posi–Full Collar, Product No. FZ67," Trico Well Completion Equipment, Composite Catalog of Oil Field Equipment and Services vol. 2 (1990–91.).
"2½ Cement Retainer Assembly," HPI High Pressure Integrity, Inc., Part No. 351–250–1 (Sep. 8, 1994.).
"Assembly, 7" to 20∝ Model 467 DV Float Collar Double Non–Circulating Fill–up Flapper with 1¾" Ball Pinned," Weatherford International, Inc. (Jul. 22, 1999.).

"Assembly, Model 367DV Float Shoe Double Non–Circulating Fill–up Flapper Downjet with Ball Pinned," Weatherford International, Inc. (Jan. 14, 2000.).

"11¾" Type 505A–DV Double–valve Auto–Fill Float Shoe," Davis–Lynch, Inc., (Dec. 4, 1998).

B & W Orifice Shoes and Collars, Trico Industries, Inc., Product Nos. FZ25 and FZ55, advertisement published in 1990–91 Composite Catalog of Oil Field Equipment and Services.

P. Head, *Slimwells Without The Pain,* SPE/IADC 52795 (1999).

P. Head, *Slimwell Concept—Innovative Coiled Tubing Completion Technology,* SPE 54492 (1999).

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–10 is confirmed.
Claims 11–18 are cancelled.

* * * * *